US008418291B2

(12) United States Patent
Hornbach et al.

(10) Patent No.: US 8,418,291 B2
(45) Date of Patent: Apr. 16, 2013

(54) PATIENT SUPPORT HAVING AN ADJUSTABLE POPLITEAL LENGTH APPARATUS, SYSTEM AND METHOD

(75) Inventors: David W. Hornbach, Brookville, IN (US); Scott A. Schultz, Batesville, IN (US); Virgil J. Niese, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 1443 days.

(21) Appl. No.: 11/194,347

(22) Filed: Aug. 1, 2005

(65) Prior Publication Data

US 2006/0021145 A1 Feb. 2, 2006

Related U.S. Application Data

(60) Provisional application No. 60/592,775, filed on Jul. 30, 2004, provisional application No. 60/592,642, filed on Jul. 30, 2004, provisional application No. 60/592,613, filed on Jul. 30, 2004.

(51) Int. Cl.
*A61G 7/15* (2006.01)

(52) U.S. Cl.
USPC ..... 5/618; 5/613; 5/616; 5/600

(58) Field of Classification Search ..... 5/600, 613, 5/616, 618
See application file for complete search history.

(56) References Cited

U.S. PATENT DOCUMENTS

| | | | | |
|---|---|---|---|---|
| 3,754,749 | A * | 8/1973 | Lyon et al. | 5/618 |
| 4,847,929 | A * | 7/1989 | Pupovic | 5/608 |
| 5,484,188 | A | 1/1996 | Stoeckl et al. | |
| 5,640,730 | A | 6/1997 | Godette | |
| 6,237,994 | B1 | 5/2001 | Bentley et al. | |
| 6,276,011 | B1 * | 8/2001 | Antinori | 5/618 |
| 6,347,420 | B2 | 2/2002 | Elliott | |
| 6,357,065 | B1 * | 3/2002 | Adams | 5/618 |
| 6,826,793 | B2 * | 12/2004 | Tekulve | 5/618 |
| 6,957,461 | B2 * | 10/2005 | Osborne et al. | 5/618 |
| 2001/0001163 | A1 * | 5/2001 | Allen et al. | 5/624 |
| 2002/0174487 | A1 | 11/2002 | Kramer et al. | |
| 2002/0178502 | A1 | 12/2002 | Beasley et al. | |
| 2005/0172405 | A1 | 8/2005 | Menkedick et al. | |

FOREIGN PATENT DOCUMENTS

| | | |
|---|---|---|
| DE | 4338659 | 5/1995 |
| EP | 0873740 | 10/1998 |

OTHER PUBLICATIONS

Designing and Selecting Long-Duration Seating for the Aging, Joseph A. Koncelik, Nursing Homes, pp. 27-28; Oct. 1993.
Article 96(2) EPC Communication dated Feb. 12, 2006, including European Search Report dated Feb. 27, 2006, for EP05254763.
Official action in EP 05 254 763.5-1257 dated Jun. 23, 2010 (5 pages).

* cited by examiner

*Primary Examiner* — William Kelleher
(74) *Attorney, Agent, or Firm* — Barnes & Thornburg LLP

(57) ABSTRACT

A patient support is provided. The patient support is configurable to support a patient in a horizontal position and a seated position. The patient support includes a back section, and a thigh section coupled to the back section. The patient support also includes an adjustment member coupled to the thigh section. The adjustment member is movable to lengthen the thigh section.
The patient support also includes a foot section coupled to the adjustment member. The foot section is pivotable into a first position substantially parallel to the thigh section to a second position substantially perpendicular to the thigh section.

29 Claims, 9 Drawing Sheets

PATIENT SUPPORT HAVING AN ADJUSTABLE POPLITEAL LENGTH APPARATUS, SYSTEM AND METHOD

RELATED APPLICATIONS

This application claims the benefit of U.S. Provisional Patent Application Ser. No. 60/592,775, filed Jul. 30, 2004 which is incorporated herein by this reference.

This application is related to pending U.S. patent application Ser. No. 10/107,777, published as US 2002/0174487, filed Mar. 27, 2002; U.S. Provisional Patent Application Ser. No. 60/591,838, entitled HOSPITAL BED filed Jul. 28, 2004 and corresponding U.S. patent application Ser. No. 11/191,651, filed Jul. 28, 2005; U.S. Provisional Patent Application Ser. No. 60/592,642, entitled PATIENT SUPPORT HAVING POWERED ADJUSTABLE WIDTH, filed Jul. 30, 2004 and corresponding U.S. patent application Ser. No. 11/192,887, filed Jul. 29, 2005; and U.S. Provisional Patent Application Ser. No. 60/592,613, entitled ADVANCED ARTICULATION SYSTEM AND MATTRESS SUPPORT FOR A BED, filed Jul. 30, 2004 and corresponding U.S. patent application Ser. No. 11/192,698, filed Jul. 29, 2005; all of which are expressly incorporated herein by reference.

BACKGROUND AND SUMMARY

The present invention relates to adjustable sections of patient supports. In particular, the present invention relates to adjustable-length deck sections of patient supports such as chairs, wheelchairs, and hospital beds.

Particularly in hospital beds that have one or more articulating deck sections, it may be desirable to adjust the length of a deck section for a variety of reasons. The length of a head, back, seat, thigh, or foot section of a patient support may be adjusted to improve patient comfort, reduce the patient's risk of developing pressure ulcers, adapt the patient support to a wide range of different patients, or to facilitate the patient's ingress or egress from the patient support.

A patient support is provided, including a back section, a thigh section coupled to the back section, an adjustment member coupled to the thigh section, the adjustment member being movable to lengthen the thigh section, and a foot section coupled to the adjustment member, the foot section being pivotable into a first position substantially parallel to the thigh section to a second position substantially perpendicular to the thigh section. The adjustment member may be a rod driven by a linear force generator. The linear force generator may be a hydraulic cylinder or a linear actuator.

The patient support may further include a pair of slides positioned adjacent to the linear force generator. Each slide may be located on either side of the linear force generator. The slides may be coupled to the foot section. The adjustment member may be further movable to shorten the thigh section.

The patient support may further include a thigh section length adjustment activator, and the adjustment member may be movable in response to activation of the thigh section length adjustment activator. The thigh section length adjustment activator may be one of a plurality of activators located on a control panel electrically coupled to the patient support.

A deck length adjuster for a patient support is also provided, including a support member at least a portion of which is shaped to be coupled to a deck section of the patient support, a linear force generator coupled to the support member, a pair of tubes, each tube being located adjacent to the linear force generator, and a pair of slides, each slide being sized to fit within an interior region of one of the tubes, and the linear force generator being operable to cause the slides to extend out of and retract into the tubes.

The deck length adjuster may include tubes that may be located on opposite sides of the linear force generator. The linear force generator may include a slidable rod. The slidable rod may have a distal end shaped to be pivotably coupled to a second deck section. Each slide may have a distal end shaped to be coupled to the second deck section. The second deck section may be pivotable to a position substantially perpendicular to the first deck section. The linear force generator may be electrically coupled to a controller. The linear force generator may cause the slides to extend out of the tubes to lengthen the deck section in response to a first signal from the controller. The linear force generator may cause the slides to retract into the tubes to shorten the deck section in response to a second signal from the controller. The controller may be electrically coupled to an input device and the first and second signals are generated in response to input received by the input device.

An adjustable-length deck section for a patient support is also provided, including a housing defining an interior region of a deck section, a length adjuster located substantially within the interior region of the housing, the length adjuster including a linear force generator, and first and second slides located on either side of the linear force generator, the linear force generator being operable to move the slides into and out of the interior region of the housing to adjust a length of the deck section. Movement of the slides out of the interior region may lengthen the deck section and movement of the slides into the interior region may shorten the deck section. The length adjuster may further include a pair of cylinders located within the interior region, and each cylinder may be sized and positioned to receive a slide as the slide retracts to shorten the deck section.

The deck section may be a thigh section and the length adjuster may be operable to adjust a popliteal length of the patient support.

A method for adjusting the popliteal length of a patient support is also provided, including the steps of receiving from a patient support a signal indicating a need to adjust the popliteal length of the patient support, determining an amount by which the popliteal length is to be adjusted, and sending to the patient support a signal including an instruction to adjust the popliteal length by the determined amount. The instruction indicating a need to adjust the popliteal length may be received from an input device of the patient support. The instruction to adjust the popliteal length may be sent to a length adjuster coupled to a thigh section of the patient support.

The determining step may further include determining whether the popliteal length is to be lengthened or shortened based on at least one of a patient's age, size, body type, body shape, gender, ethnicity, weight, height, a position of the thigh section, a position of a foot section of the patient support relative to the thigh section, a position of a back section of the patient support relative to the thigh section and a position of the seat section relative to the floor.

A system for adjusting the popliteal length of a patient support is also provided, including a patient support including a popliteal length adjuster, a controller electrically coupled to the patient support, and a memory including programming logic that when executed by the controller causes the popliteal length adjuster to adjust the popliteal length of the patient support.

The programming logic when executed causes the popliteal length adjuster to increase the popliteal length of the patient support in response to an indication that the popliteal length of a patient positioned on the patient support is longer than the popliteal length of the patient support, and causes the popliteal length adjuster to decrease the popliteal length of the patient support in response to an indication that the popliteal length of a patient positioned on the patient support is shorter than the popliteal length of the patient support. The popliteal length may be adjusted based on at least one of a patient's age, size, body type, body shape, gender, ethnicity, weight, and height.

The patient support may further include a back section, a thigh section, a seat section, and a foot section, and the popliteal length may be adjusted based on at least one of a position of the thigh section, a position of the foot section relative to the thigh section, a position of the back section relative to the thigh section and a position of the seat section relative to the floor. The patient support may further include at least two siderails and the popliteal length is adjusted based on a position of the siderails. The system may further include an input device, wherein the popliteal length is adjusted based on input received by the input device.

BRIEF DESCRIPTION OF THE DRAWINGS

The detailed description particularly refers to the accompanying figures in which.

DETAILED DESCRIPTION OF THE DRAWING

The present invention provides an adjustment apparatus which is suitable for adjusting the length of a deck section of a patient support. In the illustrated embodiment, the popliteal length of a patient support is adjustable by incorporating the adjustment apparatus into the thigh section of the patient support. The popliteal portion of the patient support supports the patient adjacent the knee joint.

Figure 1:
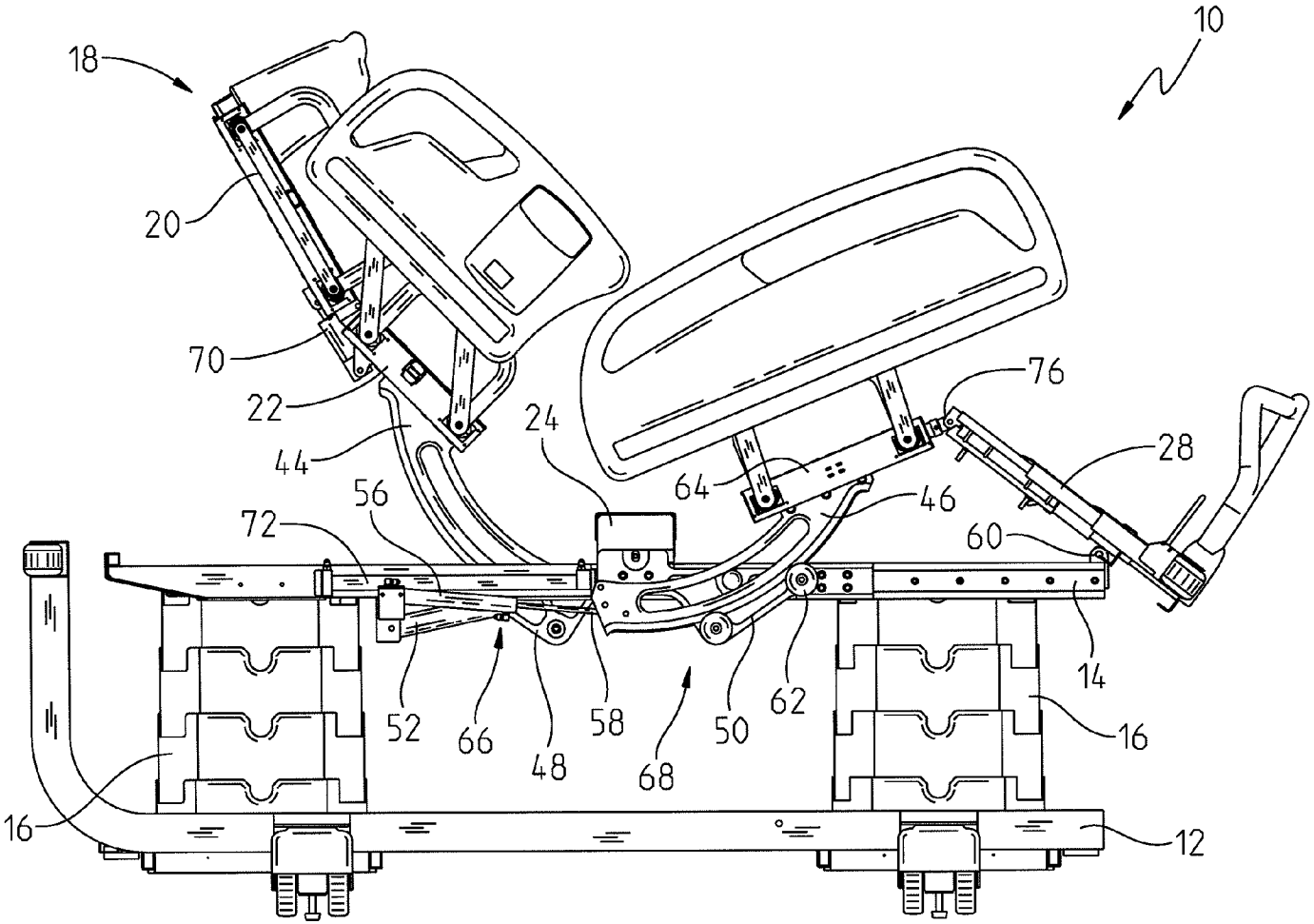
FIG. 1 is a side view of a patient support including a length adjuster in accordance with the present invention.
Figure 7:
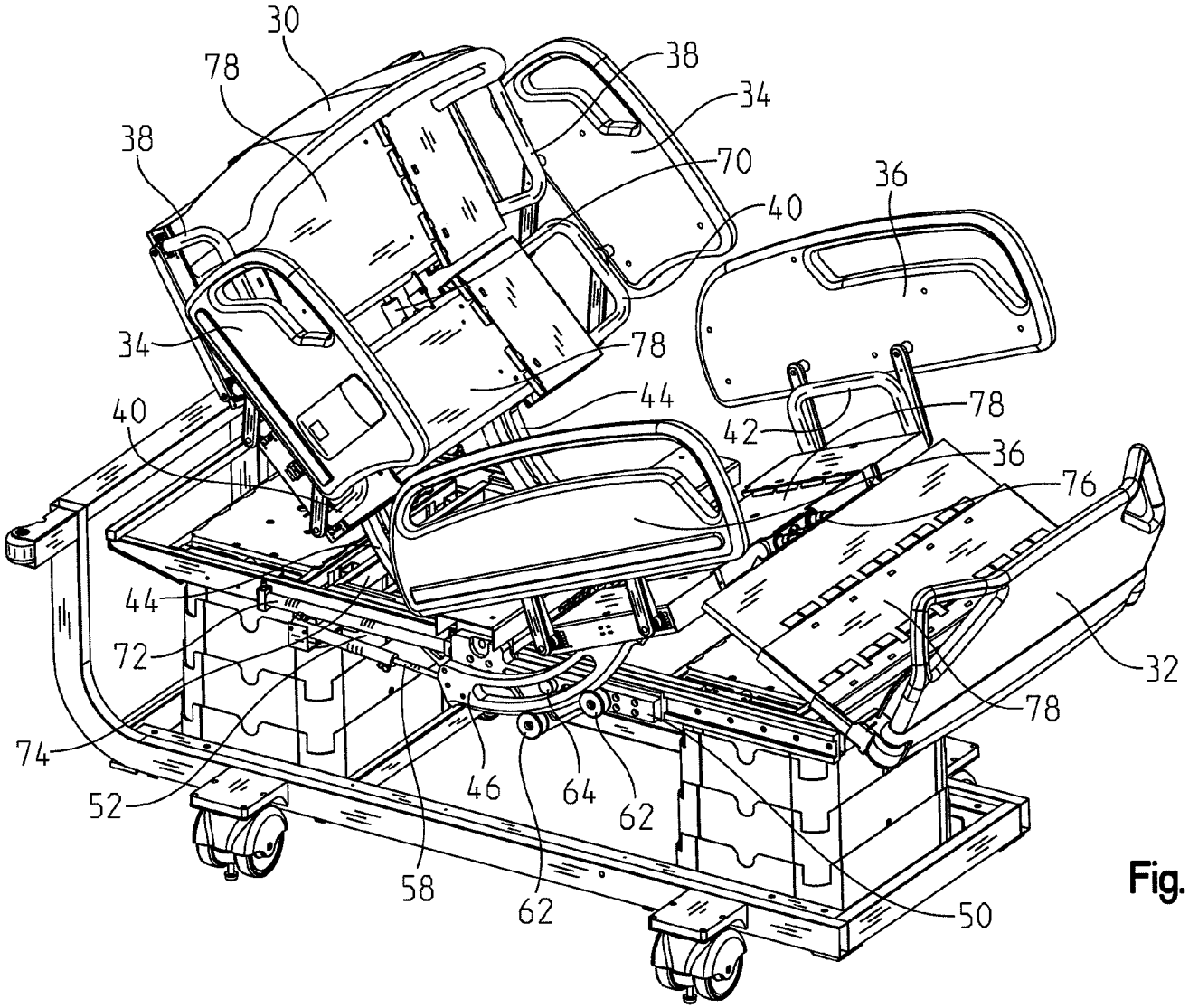
FIG. 7 is a perspective view of the patient support of FIG. 1.

FIGS. 1 and 7 are different views of one embodiment of a patient support in which the length adjuster of the present invention may be used. FIGS. 1 and 7 show a hospital bed with articulating deck sections, but is understood that the length adjuster of the present invention could also be used in other types and models of beds and other patient supports, including chairs and wheelchairs.

Referring now to FIGS. 1 and 7, the patient support 10 includes a base 12, a frame 14, vertical support portions 16 positioned between the frame 14 and the base 12, and a deck 18. The frame 14 is supported by the vertically movable support portions 16, which allow the frame 14 to be raised and lowered with respect to the base 12.

The deck 18 includes a plurality of deck sections, including a head section 20, a back section 22, a seat section 24, a thigh section 26, and a foot section 28. In the illustrated embodiment, all of the deck sections except for the seat section 24 are articulating deck sections, however it is understood that in other embodiments, the seat section 24 articulates, or one or more of the other seat sections 20, 22, 26, 28 do not articulate.

Also provided in the illustrated embodiment are a headboard 30, a footboard 32, a pair of back section siderails 34, a pair of thigh section siderails 36, and multiple pairs of mattress support members 38, 40, and 42.

In the illustrated embodiment, articulation of an upper deck portion of the patient support 10, which includes the back section 22 and the head section 20, is provided by an upper deck articulation system 66. The upper deck articulation system 66 includes a pair of upper deck arcuate members 44, a pair of upper deck supports 48, a pair of upper deck articulation system actuators 52, including a pair of upper deck articulation system rods (not shown), a pair of bottom rollers (not shown), and an inner roller (not shown).

A lower portion of the deck 18 includes the thigh section 26 and the foot section 28. The lower portion of the deck 18 is articulated by a lower deck articulation system 68. The lower deck articulation system 68 includes a pair of lower deck arcuate members 46, a pair of lower deck supports 50, a pair of lower deck articulation system actuators 56, including rods 58; a pair of bottom rollers 62, and an inner roller 64.

In general, the upper deck articulation system 66 operates to raise and lower the back section 22 and the head section 20 relative to the frame 14, and the lower deck articulation system 68 operates to raise and lower the thigh section 26 and the foot section 28 relative to the frame 14. The various details and aspects of the upper and lower articulation systems 66, 68 of the illustrated embodiment are described in a U.S. Provisional Patent Application Ser. No. 60/592,613, entitled "ADVANCED ARTICULATION SYSTEM AND MATTRESS SUPPORT FOR A BED", filed Jul. 30, 2004, and its corresponding U.S. patent application Ser. No. 11/192,698, which are incorporated herein by reference.

Also provided in the illustrated embodiment are a pair of head section actuators 70, a sliding subframe actuator 72, and a sliding subframe 74. The head section actuators 70, in general, operate to adjust the angle of the head section 20 in response to articulation of the back section 22 by the upper deck articulation system 66. As the back section 22 is raised, the head section actuators 70 cause the head section 20 to tilt forward, and vice-versa.

The sliding subframe 74 is a portion of the frame 14 that is horizontally movable forward and backward along a longitudinal axis of the frame 14. The sliding subframe actuators 72 drive the movement of the subframe 74.

In the illustrated embodiment, the sliding subframe 74 is movable into a position near the foot end of the patient support 10 to allow the patient support 10 to assume a chair position. Aspects of the patient support 10 relating to the sliding subframe 74 are described in U.S. Provisional Patent Application Ser. No. 60/592,540, entitled "BED HAVING A CHAIR EGRESS POSITION", filed Jul. 30, 2004, and its corresponding U.S. patent application Ser. No. 11/192,897, which are incorporated herein by reference. As explained therein the length of foot section 28 is also adjustable.

The foot section 28 is pivotably or hingedly coupled to the thigh section 26 at a joint 76. A foot section roller 60 supports the foot section 28 above the frame 14. The foot section roller 60 is coupled to the frame 14. As the sliding subframe 74 moves toward the foot end of the patient support 10, the foot section 28 rotates downwardly toward the base 12 into a position that is substantially perpendicular to the frame 14, or to the thigh section 26, if the thigh section 26 is elevated. The foot section roller 60 guides the movement of the foot section 28 relative to the frame 14.

As best shown in FIG. 7, each of the deck sections 20, 22, 24, 26, 28 includes a housing 78. Each deck section housing 78 defines an interior region in which substantial portions of a length adjuster may be located.

Figure 4:
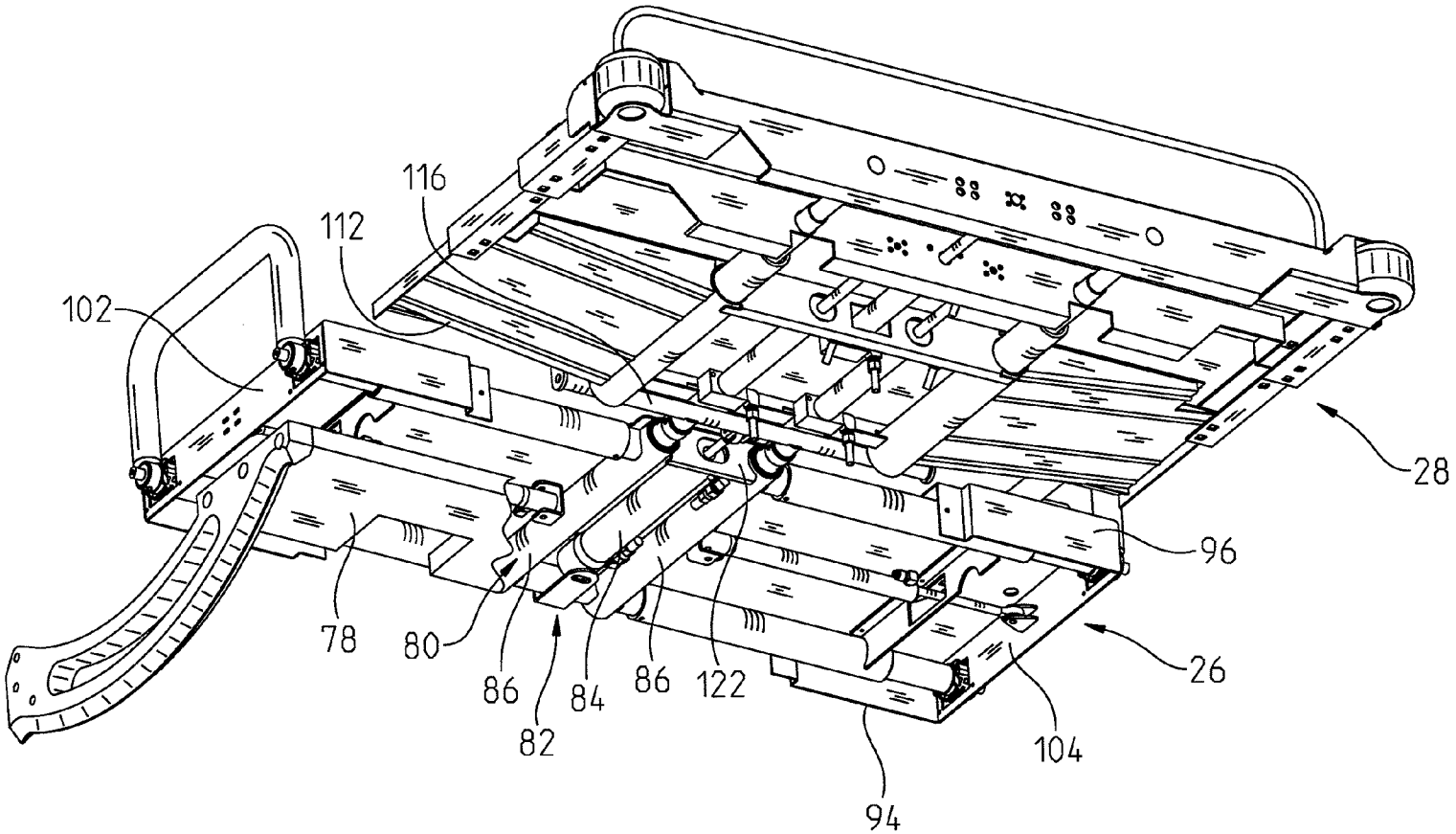
FIGS. 4 and 5 are perspective views from the point of view of a person looking upward underneath the thigh and foot sections, showing the length adjuster in the retracted and extended positions, respectively.
Figure 5:
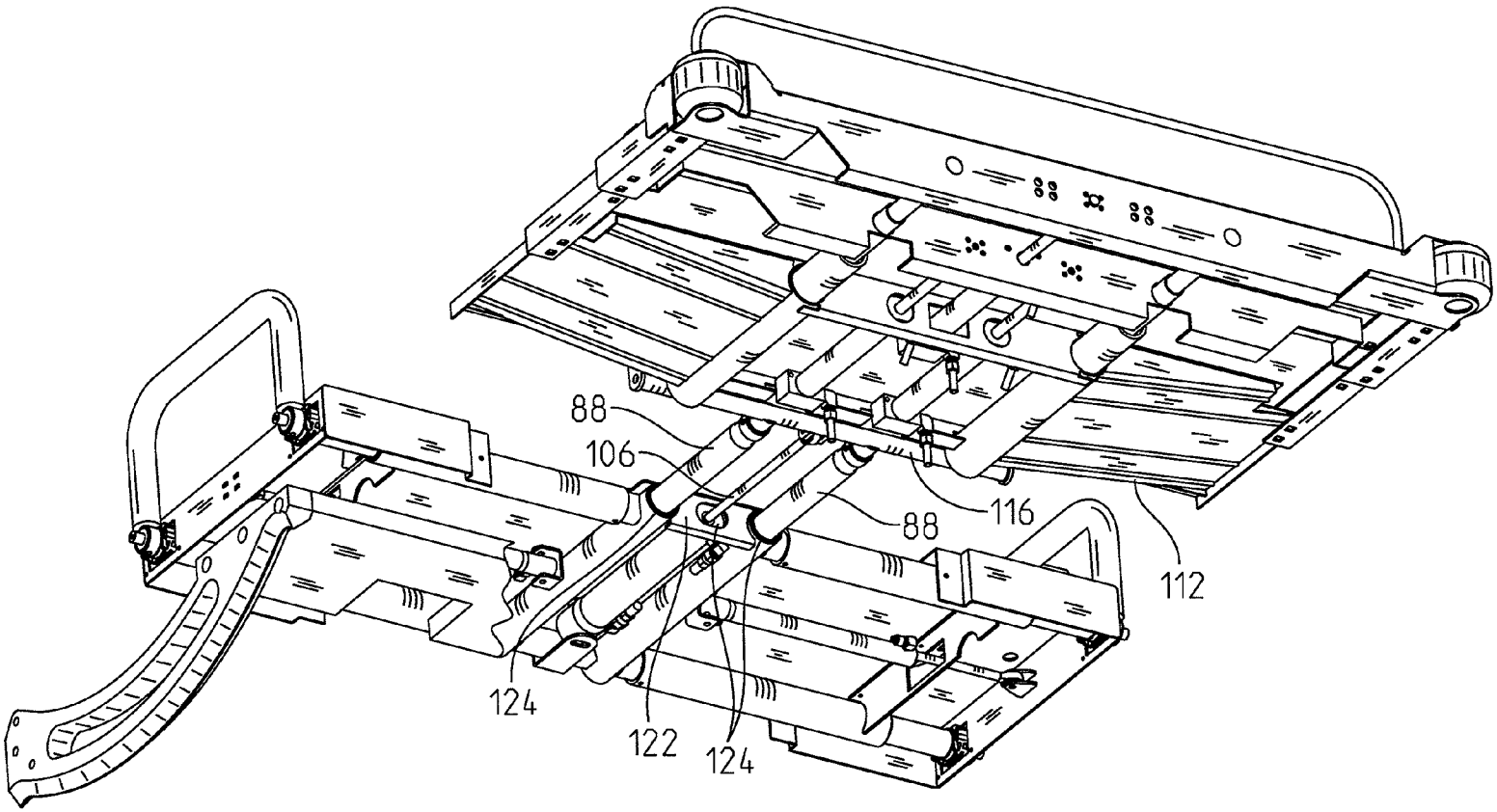
Figure 8:
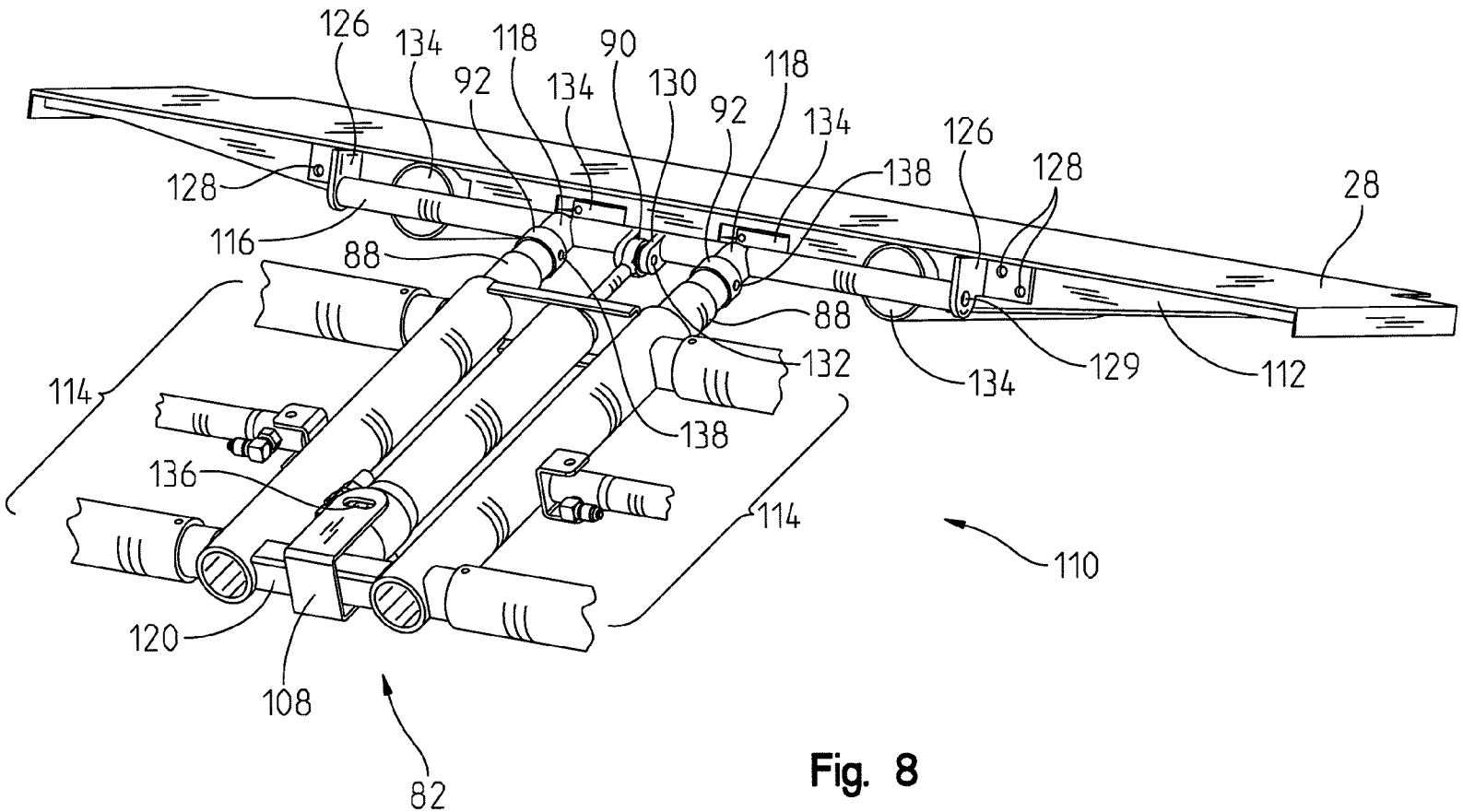
FIG. 8 is a perspective view of a thigh section length adjuster in accordance with the present invention.

In the illustrated embodiment, a length adjuster is located in the thigh section 26. FIGS. 4, 5, and 8 show portions of the thigh section length adjuster 82 located in an interior region 80 defined by the housing 78. Portions of the housing 78 are cut away to show the interior region 80. FIGS. 4, 5, and 8 are discussed below.

Figure 2:
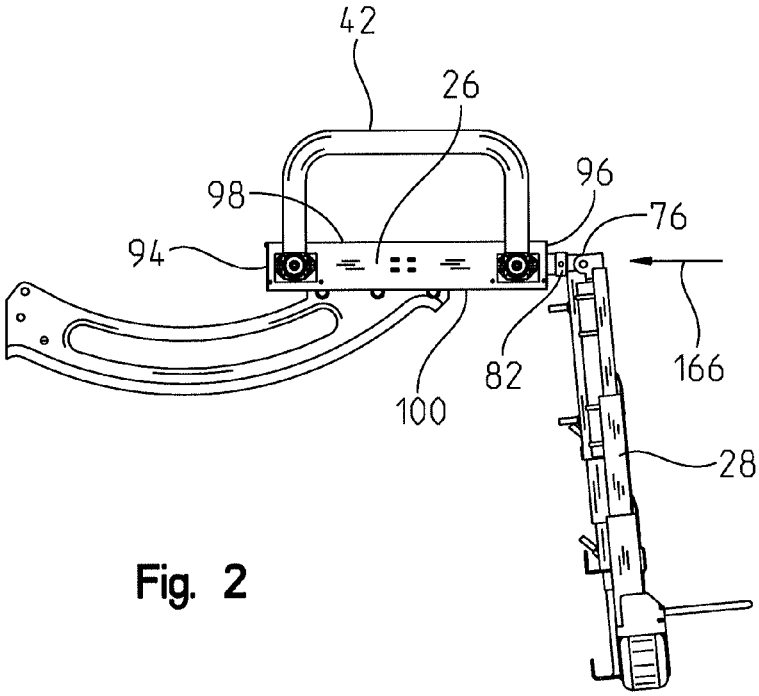
FIGS. 2 and 3 are side views of the thigh and foot sections of the patient support shown in FIG. 1, with the length adjuster retracted and extended, respectively.
Figure 3:
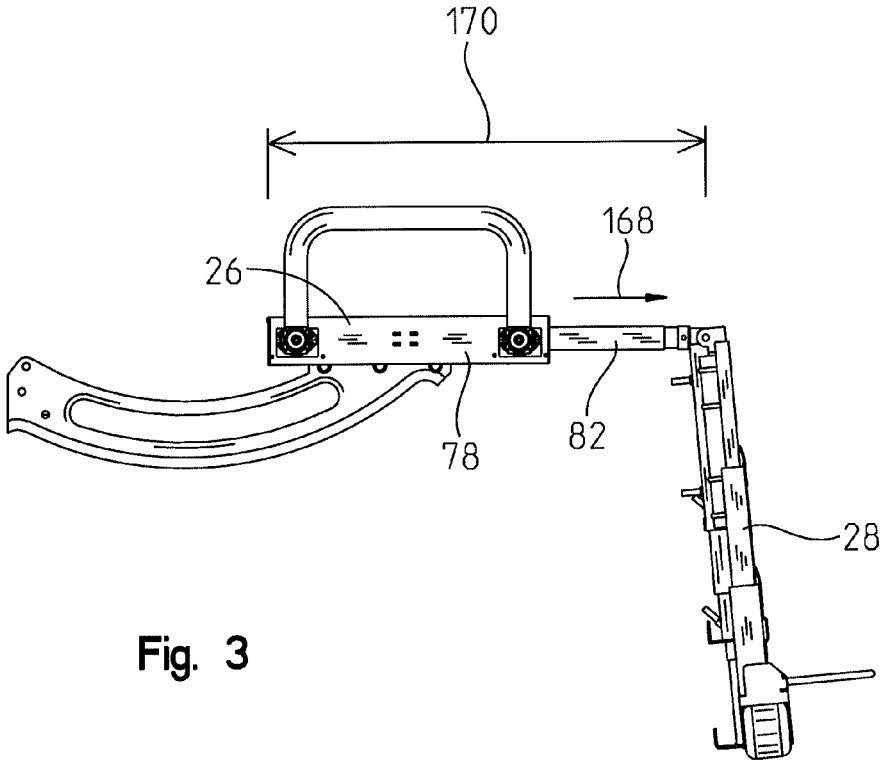

FIGS. 2 and 3 illustrate the operation of a deck length adjuster in accordance with the present invention. The illustrated embodiments show the deck length adjuster 82 being used to extend and retract the length of the thigh section 26, but it is understood that the deck length adjuster 82 could be used in connection with other deck sections.

As shown, the thigh section 26 includes a first end 94, a second end 96, a top surface 98 and a bottom surface 100. FIG. 2 shows the thigh section length adjuster 82 in a retracted position. In the retracted position, the thigh section 26 is at its shortest length. In this position, the joint 76 is adjacent to the second end 96 of the thigh section 26. Retraction of the length adjuster 82 is accomplished by moving portions of the length adjuster 82 in the direction of arrow 166.

FIG. 3 shows the length adjuster 82 in an extended position with portions moved in the direction of the arrow 168. Extension of the length adjuster 82 increases the length of the thigh section 26. The structure of the length adjuster 82 is described below in connection with FIGS. 4, 5 and 8.

While the foot section 28 is shown in a substantially vertical position, perpendicular to the thigh section 26, it is not necessary that the foot section 28 be in this position in order for the length adjuster 82 to operate.

By increasing or decreasing the length of thigh section 26 as shown in FIGS. 2 and 3, the popliteal length 170 of the patient support 10 is adjustable. Adjusting the popliteal length 170 of the patient support 10 is accomplished by adjusting the location of the pivot point 76 between the thigh and foot sections relative to the seat section 24.

Adjustment of the popliteal length 170 of the patient support 10 is thought to facilitate and improve the ease of ingress and egress from the bed by patients within a wide range of body dimensions and age ranges, and improve comfort for a variety of different patient types. For example, patients of different heights are likely to have substantially similar hip pivot point locations, but their knee pivot points will often be substantially different due to the differences in the popliteal length. A taller person would have, in general, a longer popliteal length than a shorter person. Also, adjusting the patient support to a shorter popliteal length may be preferable for overweight or elderly patients, who may need assistance in ingressing or egressing the patient support. Methods of adjusting the popliteal length and determining an appropriate popliteal length for a given patient are discussed in greater detail in connection with FIGS. 9 and 10.

The structure of one embodiment of the length adjuster 82 is shown in FIGS. 4, 5, and 8. In FIGS. 4 and 5, a first deck section which has a length adjuster 82 is shown coupled to a second deck section. In the illustrated embodiment, the first deck section is a thigh section 26, and the second deck section is a foot section 28.

The thigh section 26 has a first end 94, a second end 96, a first side 102, and a second side 104. The second end 96 of the thigh section 26 is coupled to a front edge 112 of the foot section 28 as described below in connection with FIG. 8.

A housing 78 encloses an interior region 80 of the thigh section 26. The length adjuster 82 is located within the interior region 80. As shown, the length adjuster 82 is located substantially in the middle of the interior region 80 of the thigh section 26. The length adjuster 82 includes a linear force generator 84 and a pair of slide tubes 86. As shown, the slide tubes 86 are positioned on either side of the linear force generator 84. The linear force generator 84 is, in the illustrated embodiment, a hydraulic cylinder. However, it is understood that the linear force generator could also be a linear actuator, or other suitable linear force generating device.

FIG. 4 shows the length adjuster 82 in its fully retracted position. In this position, the thigh section 26, and thus the popliteal length of the patient support 10, are at their shortest lengths.

FIG. 5 shows the length adjuster 82 in an extended position. When the length adjuster 82 is extended, the thigh section 26 is extended along its longitudinal length, and the popliteal length 170 of the patient support 10 is correspondingly increased.

In FIG. 5, it is shown that the linear force generator 84 includes a rod or piston 106. The rod or piston 106 extends outwardly away from the second end 96 of the thigh section 26 to lengthen the thigh section 26, and retracts inwardly into the interior region 80 of the thigh section 26 toward the first end 94 to decrease the length of thigh section 26.

When the thigh section 26 is extended, a pair of slide tubes 88 extend outwardly away from the second end 96 when the thigh section 26 is lengthened, and retract inwardly into the slide tubes 86, toward the first end 94, when the longitudinal length of the thigh section 26 is shortened.

Each of the rods 106 and slide tubes 88 has a distal end which is coupled to a horizontal support member 116, which is coupled to the front edge 112 of the foot section 28.

A support plate 122 is positioned along the second end 96 of the thigh section 26. The support plate 122 includes shaped regions and apertures 124 corresponding to each of the slide tubes 88 and the rod 106, respectively. When the length of the thigh section 26 is extended, the slide tubes 88 and the rod 106 extend out of the housing 78 through the corresponding shaped regions and apertures 124 in the support plate 122.

The center region 110 of the thigh section 26, including the length adjuster 82, is shown in FIG. 8 with the housing 78 stripped away. As shown, portions of a width adjuster 114 are positioned perpendicularly to each of the slide tubes 88 within the interior region 78 of the thigh section 26. The width adjuster is the subject of U.S. Provisional Patent Application Ser. No. 60/592,642, entitled "*PATIENT SUPPORT HAVING POWERED ADJUSTABLE WIDTH*", filed Jul. 30, 2004, and its corresponding U.S. patent application Ser. No. 11/192,887, which are incorporated herein by reference.

A substantially C-shaped mounting bracket 108 is used to maintain the position of the linear force generator 84 in the interior region 80, particularly with respect to the slide tubes 86, and/or to couple the linear force generator 84 to the thigh section 26. This mounting bracket 108 extends around a substantially rectangular support member 120, which connects the slide tubes 86 to each other. The mounting bracket 108 is coupled to the linear force generator 84 by an aperture 136 which is configured to receive a pin, bolt, or other suitable fastener. Each end of the support 120 is illustratively coupled to a slide tube 86 by welding or other suitable methods.

The slide tubes 88 and the rod 106 are coupled to the horizontal support bar 116. The bar 116 is coupled to the front edge 112 of the foot section 28 by a pair of substantially L-shaped brackets 126. Each of the brackets 126 includes a plurality of apertures 128, which are sized to receive a pin, screw, bolt, or other suitable fastener, for coupling the bar 116 to the front edge 112.

The bar 116 illustratively includes a pair of molded portions 118 which extend substantially perpendicularly away from the bar 116 toward the slide tubes 88. These bar portions 118 are coupled to each of the slide tubes 88, respectively, by flanges 92 and pins 138.

The bar 116 also includes a pair of ears 130. Each ear 130 includes an aperture 132. The rod 106 of the linear force generator 84 at its distal end includes a substantially, circular, elliptical, or U-shaped coupling portion 90 which includes an aperture (not shown) that aligns with the ear apertures 132 to couple the rod 106 to the bar 116 by a suitable pin, bolt, or other fastener.

The foot section 28 is pivotable downwardly into a position substantially perpendicular to the thigh section 26. This is accomplished by the brackets 126 being pivotably coupled to the horizontal bar 116 by pivot couplers, such as pins (not shown) located in the apertures 129, so that the foot section 28 rotates around the bar 116.

In the illustrated embodiment, the foot section 28 also includes a plurality of apertures 134. It is understood that these apertures 134 are not required by the present invention.

Figure 6:
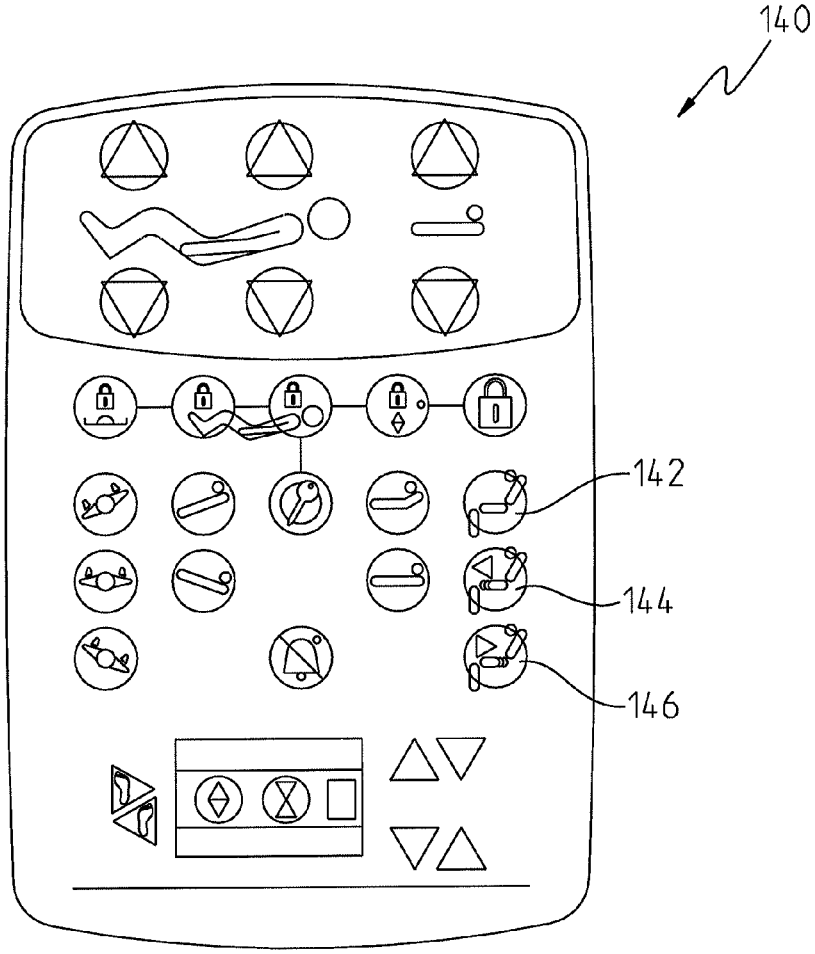
FIG. 6 is an exemplary control panel for use with the patient support, which includes activators for adjusting the length of a deck section of the patient support.

In FIG. 6, an exemplary control panel 140 for use in connection with the patient support 10 is shown. The illustrated control panel 140 includes a plurality of activators, each of which, when activated, provide electrical signals including control instructions to the patient support 10.

Among these activators are a chair position activator 142, and a pair of popliteal length adjustment activators 144, 146.

In the illustrated embodiment, the activators 142, 144, 146 are shown as push buttons. However, it is understood that they may be implemented as icons on a touch screen, for example, or may take any other form of a suitable input device, such as a pen-based input device, a voice activated device, a keyboard, mouse, track ball, joystick, or keypad.

The chair position activator 142, when activated for example by a caregiver or a patient, causes the patient support 10 to move into a chair position. In the illustrated embodiment, the chair position is achieved by elevating the head and back sections and rotating the foot section downwardly toward the base so that it is substantially perpendicular with the thigh section.

The popliteal length adjustment activators 144, 146, when activated, lengthen or shorten or the thigh section 26 of the patient support 10, and thus adjust the popliteal length 170 of the patient support. The activator 144 when activated extends or lengthens the thigh section 26, and the activator 146 when activated retracts or shortens the thigh section 26.

Figure 9:
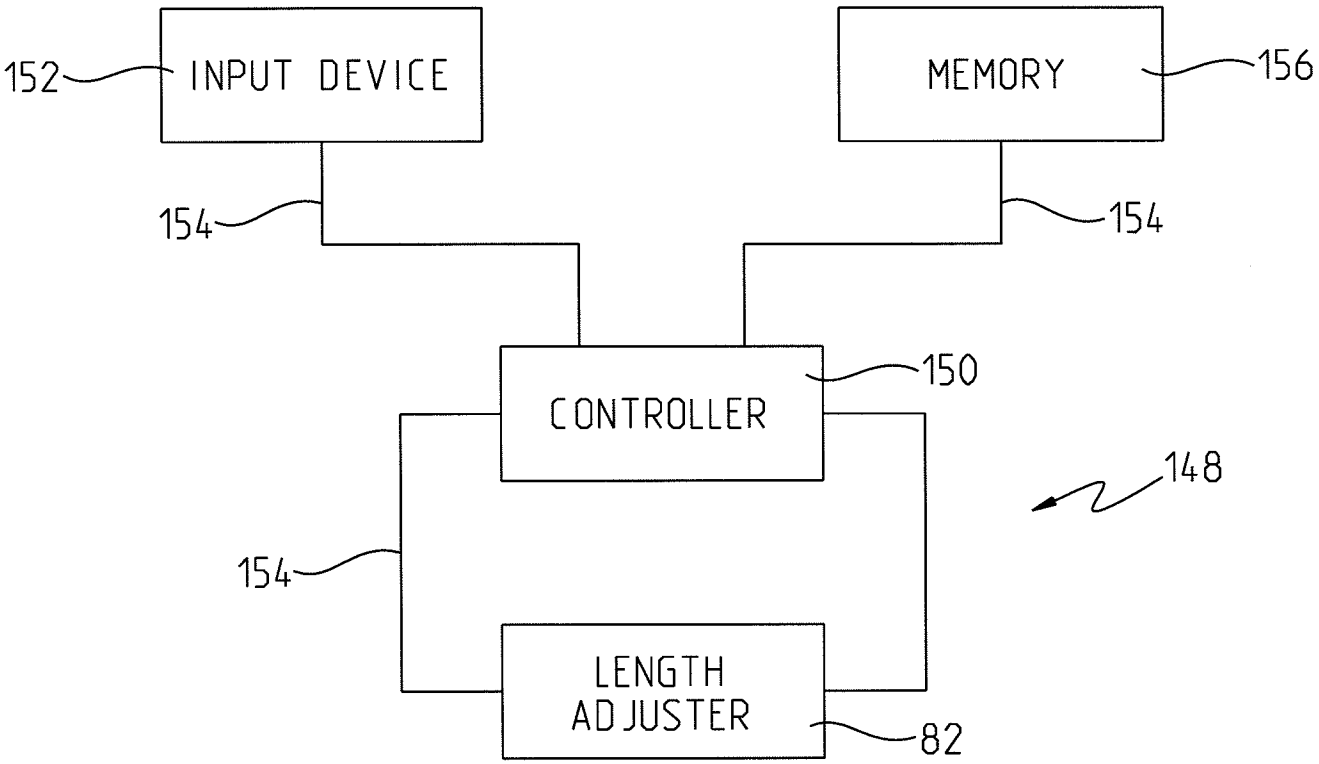
FIG. 9 is a block diagram of a control system for adjusting the length of a deck section of a patient support.

FIG. 9 is a block diagram of a control system 148 for adjusting the popliteal length of a patient support 10. In the illustrated embodiment, the control system 148 includes a controller 150, an input device 152, a memory 156, the length adjuster 82, and electrical connections 154. The input device 152 is, for example, a control panel such as is illustrated in FIG. 6.

The controller 150 is an electrical component that receives input signals from the input device 152 and as needed, data from the memory 156. The controller processes the input signals and the data and transmits control signals to the length adjuster 82 to lengthen or shorten the popliteal length of the patient support 10. The controller 150 also receives information from the length adjuster 82, such as the current position of the rod 106 and slides 88, and uses that information to generate appropriate control signals.

The memory 156 is any suitable computer memory, such as EEPROM. In the illustrated embodiment, a look-up table or database is stored in the memory 156, which contains data to enable the controller 150 to determine the appropriate control signal to transmit to the length adjuster 82. For example, a look-up table in the memory 156 includes data relating to an appropriate length of travel and direction of travel for the slides 88 and the rod 106 in view of a variety of parameters. These parameters include the patient's size (i.e., small, medium, large, extra large), height, weight, age, body type, and/or gender, and/or parameters relating to the current position of the patient support 10.

The patient support parameters include, for example, the angle or current position of the head section relative to the thigh section, the angle or current position of the thigh section relative to the seat section, the angle or current position of the foot section relative to the thigh section, the height of the siderails, the slope of the seat section (i.e., whether negative), and/or the height of the seat section from the floor.

The memory 156 also stores current information about the position of the slides 88 and/or rod 106. In addition, the memory 156 stores the programming logic which is executed by the controller 150 to analyze the input signals and data from memory 156, as needed, to generate appropriate control signals for the length adjuster.

Figure 10:
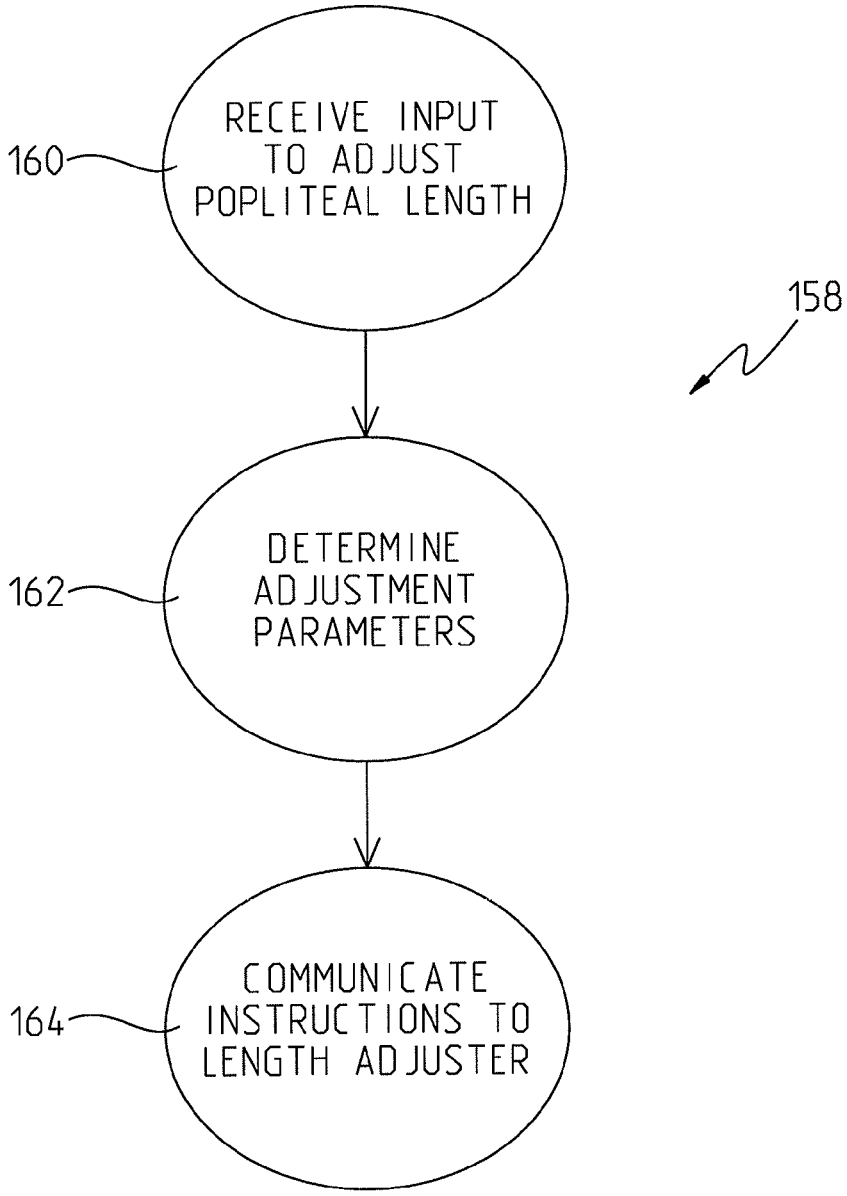
FIG. 10 is a flow diagram of a method for adjusting the popliteal length of a patient support.

In FIG. 10, a flow diagram of the steps of an algorithm embodied in programming logic and stored in the memory 156 to be executed by the controller 150 is shown.

At step 160, input is received which indicates the need to adjust the popliteal length of the patient support. In certain embodiments, the input is an indication of the patient's size, height, weight, body type, age, or gender. For example, in certain embodiments the control panel 140 includes an input area to enter the patient's size (i.e., S, M, L, XL). Alternatively or in addition, the input is an indication that the patient support is in a certain position or has changed position, such as an indication that the patient support has been moved into the chair position. The input could also be a signal generated by activation of one of the activators 142, 144, 146, indicating a need to increase or decrease the popliteal length.

In general, the input is received from the input device 152. However, the input signal could also be automatically generated, for example upon movement of the patient support into the chair position or upon a determination that the patient has not changed position for a certain period of time.

At step 162, the parameters needed to adjust the popliteal length of the patient support appropriately are determined. These parameters include the direction of adjustment (i.e., increasing or decreasing the popliteal length), and the amount by which the popliteal length should be increased or decreased (also referred to as the length of travel).

In the illustrated embodiment, the adjustment parameters are obtained from a look-up table stored in the memory 156. The adjustment parameters are determined based on one or more of the factors discussed herein. For example, it may be desirable to adjust the popliteal length if a patient has been seated for a long period of time, in order to enhance the patient's comfort level. As another example, the body dimensions of the patient may require an adjustment of the popliteal length. For example, taller patients generally require a longer popliteal length and shorter patients generally require a shorter popliteal length.

The age of the patient may also be a factor. Older adults may have lesser upper leg or arm strength than young adults and also may be less flexible in the knee and hip joints than younger adults. Consequently, older adults may not be able to move into and out of a seated position easily. The popliteal length of the patient support may be shortened to aid older patients in moving out of or into the patient support more easily.

Further, the patient's gender may be an important factor. In general, men and women have different preferences regarding the preferred angle of recline in the back of a chair. As a result, the popliteal length may need to be adjusted in order to facilitate ingress or egress from the chair based on the amount of recline in the back angle.

In general, the current standard dimension for popliteal length is about 17 inches. In general, the amount of adjustment of the popliteal length is within the range of about 10 to about 30 inches. In the illustrated embodiment, the popliteal length can be decreased to about 14 inches and increased to about 20 inches.

At step 164, a control signal containing the adjustment parameters (i.e., the amount and direction of adjustment) is communicated to the length adjuster 82. An electrical signal is provided to the length adjuster 82 which causes the length adjuster 82 to be activated for a predetermined amount of time in the predetermined direction. For example, if it is determined, based on an input signal and/or one or more of the factors described above, that the popliteal length is to be increased by one inch, then the controller 150 will send a control signal to activate the length adjuster 82 to move the rod 106 and slides 88 outwardly away from the thigh section 26 for the required period of time to accomplish one inch of linear movement, and vice-versa.

As discussed herein and in the co-pending applications incorporated by reference, the patient support of the present invention has a powered adjustable width, and adjustable popliteal length and adjustable length foot section all in combination.

Although the present invention has been described in detail with reference to a certain illustrated embodiment, there are variations and modifications that exist within the scope and spirit of the present invention, which is described and as defined in the following claims.

The invention claimed is:

1. A patient support, comprising: a back section, a thigh section coupled to the back section, an adjustment member coupled to the thigh section, the adjustment member being movable to lengthen the thigh section, and a foot section pivotably coupled to the adjustment member, the foot section being pivotable relative to the thigh section between a first position substantially parallel to the thigh section and a second position substantially perpendicular to the thigh section.

2. The patient support of claim 1, wherein the adjustment member is a rod driven by a linear force generator.

3. The patient support of claim 2, wherein the linear force generator is one of a hydraulic cylinder and a linear actuator.

4. The patient support of claim 2, further comprising a pair of slides positioned adjacent to the linear force generator.

5. The patient support of claim 4, wherein each slide is located on either side of the linear force generator.

6. The patient support of claim 5, wherein the slides are coupled to the foot section.

7. The patient support of claim 1, wherein the adjustment member is further movable to shorten the thigh section.

8. The patient support of claim 1, further comprising a thigh section length adjustment activator, and the adjustment member is movable in response to activation of the thigh section length adjustment activator.

9. The patient support of claim 8, wherein the thigh section length adjustment activator is one of a plurality of activators located on a control panel electrically coupled to the patient support.

10. A patient support comprising a frame, a deck supported by the frame, the deck including a plurality of deck sections comprising a head section, a seat section, a thigh section, and a foot section, each of the deck sections having a first side and a second side transversely spaced from the first side to define a width of the deck section, each of the deck sections having a first end and a second end being longitudinally spaced from the first end to define a length of the deck section, the head section being pivotable relative to the frame about a first transverse axis, the thigh section being pivotable relative to the frame about a second transverse axis, the foot section being pivotable relative to the thigh section about a third transverse axis, a length adjuster coupled to the thigh section and movable to vary the distance between the second transverse axis and the third transverse axis, a width adjuster coupled to at least one of the deck sections, and a controller operably coupled to the length adjuster to adjust the length of the thigh section and operably coupled to the width adjuster to adjust the width of the at least one deck section.

11. The patient support of claim 10, wherein the length adjuster includes a plurality of substantially parallel length-adjusting members, each of the length-adjusting members has a first end and a second end longitudinally spaced from the first end, the first end of each of the length-adjusting members is coupled to the second end of the thigh section, the second end of each of the length-adjusting members is longitudinally movable relative to the thigh section, further comprising a linear force generator coupled to at least one of the length adjusting members and configured to push the length-adjusting members outwardly away from the thigh section to lengthen the thigh section and pull the length-adjusting members inwardly toward the thigh section to shorten the thigh section, and wherein the thigh section includes an upwardly facing top surface and the length-adjuster is located below the top surface of the thigh section.

12. The patient support of claim 11, wherein a width adjuster is coupled to the thigh section and the width adjuster includes at least one width-adjusting portion positioned perpendicularly to the length adjuster and located below the top surface of the thigh section.

13. A patient support comprising a base, at least one vertically movable support portion coupled to the base, a frame supported by the at least one vertically movable support portion to be raisable and lowerable relative to the base, a seat section coupled to the frame, the seat section having a first end and a second end longitudinally spaced from the first end, a head section pivotably coupled to the frame proximate the first end of the seat section, a thigh section pivotably coupled to the frame and having a first end proximate the second end of the seat section and a second end longitudinally spaced from the first end, a foot section having a first end and a second end longitudinally spaced from the first end, a length adjuster having a first end coupled to the thigh section and a second end longitudinally spaced from the first end to define a distance between the first and second ends of the length adjuster, a joint at which the first end of the foot section is pivotably coupled to the second end of the length adjuster to pivot the foot section about a transverse axis relative to the length adjuster, the length adjuster movable to change the position of the joint relative to the first end of the thigh section, and a controller operably coupled to the length adjuster to increase or decrease the distance between the first and second ends of the length adjuster, thereby increasing or decreasing the longitudinal length of the thigh section.

14. The patient support of claim 13, wherein the at least one vertically movable support portion includes a first support portion located proximate a head end of the frame and a second support portion longitudinally spaced from the first support portion, and each of the first and second support portions includes a plurality of substantially identically shaped sections.

15. The patient support of claim 14, further comprising a back section coupled to the head section and at least one head section actuator coupled to the head section, wherein the controller is operably coupled to the back section to rotate the back section about a transverse axis relative to the frame and the controller is operably coupled to the at least one head section actuator to pivot the head section about a transverse axis relative to the back section as the back section rotates.

16. A patient support comprising a frame, a plurality of deck sections supported by the frame, each deck section having a first side and a second side transversely spaced from the first side and a first end and a second end longitudinally spaced from the first end, the deck sections including a head section, a thigh section including a thigh section length adjuster, and a foot section, the thigh section being pivotable relative to the frame about a first transverse axis to raise and lower the thigh section above the frame, the foot section being coupled to the thigh section such that at least the first end of the foot section is raised above the frame when the thigh section is raised above the frame and at least the second end of the foot section angles downwardly relative to the frame when the thigh section is raised above the frame, a roller coupled to the frame at a fixed position, an outer surface of the roller engaging the foot section as it angles downwardly relative to the frame, and a controller operably coupled to the thigh section to raise and lower the thigh section relative to the frame.

17. The patient support of claim 16, further comprising a subframe longitudinally movable relative to the frame, and a seat section coupled to the longitudinally movable subframe, wherein the controller is operably coupled to the subframe to move the subframe and the seat section along a longitudinal length of the frame, and the roller frictionally engages the foot section as the seat section moves along the longitudinal length of the frame.

18. The patient support of 17, further comprising a control panel operably coupled to the controller, wherein the control panel includes a first popliteal length adjustment activator configured to transmit a first signal to the controller to extend the popliteal length of the patient support and a second popliteal length adjustment activator configured to transmit a second signal to the controller to shorten the popliteal length of the patient support.

19. The patient support of claim 10, wherein the length adjuster includes a linear force generator includes a slidable rod having a distal end pivotably coupled to the foot section.

20. The patient support of claim 16, wherein the roller frictionally engages an underside of the foot section as it angles downwardly relative to the frame.

21. The patient support of claim 16, wherein at least a portion of the roller extends above the frame.

22. The patient support of claim 16, further comprising a base, wherein the frame is not longitudinally movable relative to the base.

23. The patient support of claim 22, further comprising at least one vertically movable support portion positioned between the base and the frame.

24. The patient support of claim 13, wherein the length adjuster comprises a support member at least a portion of which is shaped to be coupled to the thigh section of the patient support, a linear force generator coupled to the support member, a pair of tubes, each tube being located adjacent to the linear force generator, and a pair of slides, each slide being sized to fit within an interior region of one of the tubes, and the linear force generator being operable to cause the slides to extend out of and retract into the tubes, the linear force generator including a slidable rod having a distal end of the rod at the second end of the length adjuster.

25. The patient support of claim 24, wherein the tubes are located on opposite sides of the linear force generator.

26. The patient support of claim 24, wherein the linear force generator is one of a hydraulic cylinder and a linear actuator.

27. The patient support of claim 24, wherein the foot section is pivotable between a first position substantially parallel to the thigh section and a second position substantially perpendicular to the thigh deck section.

28. The patient support of claim 24, wherein the linear force generator is coupled to the controller and causes the slides to extend out of the tubes to lengthen the thigh section in response to a first signal from the controller and causes the slides to retract into the tubes to shorten the thigh section in response to a second signal from the controller.

29. The patient support of claim 28, wherein the controller is electrically coupled to an input device and the first and second signals are generated in response to input received by the input device.

* * * * *